US005114145A

United States Patent [19]

Yamaguchi et al.

[11] Patent Number: 5,114,145

[45] Date of Patent: May 19, 1992

[54] TENNIS RACKET FRAME

[75] Inventors: Tetsuo Yamaguchi, Nishinomiya; Hiroomi Matsushita; Kunio Niwa, both of Kobe, all of Japan

[73] Assignee: Sumitomo Rubber Industries, Ltd., Hyogo, Japan

[21] Appl. No.: 595,365

[22] Filed: Oct. 10, 1990

[30] Foreign Application Priority Data

Dec. 5, 1989 [JP] Japan ..... 1-315682

[51] Int. Cl.[5] ..... A63B 49/10

[52] U.S. Cl. ..... 273/73 F; 273/DIG. 23; 273/73 R

[58] Field of Search ..... 273/73 R, 73 C, 73 F, 273/DIG. 23

[56] References Cited

U.S. PATENT DOCUMENTS 4,291,574 9/1981 Frolow ..... 273/73 C
4,357,013 11/1982 Fernandez et al. ..... 273/73 F
4,506,887 3/1985 Trysinsky ..... 273/73 F
4,539,253 9/1985 Hirschbuehler et al. ... 273/DIG. 23
4,643,857 2/1987 Cousin et al. ..... 273/73 C

OTHER PUBLICATIONS

Advertisement found in *Popular Science*, p. 110, Sep. 1985.

*Primary Examiner*—Edward M. Coven
*Assistant Examiner*—Raleigh W. Chiu

[57] ABSTRACT

The tennis racket frame according to the present invention has a total weight of 230–300 g and total length of 52–67 cm and a periodic damping ratio of 0.5–4.0%, which is constituted of a fiber reinforced resin composed of polyamide resin reinforced by a continuous fiber and/or long fiber reinforcing material. A resin layer containing a non-woven fabric may be provided at the inside, outside or/and in the middle of the fiber reinforced resin layer. Because of this structure, the tennis racket frame of the present invention can be light in weight and compact in size with a large periodic damping property, making it possible to avoid tennis elbow.

11 Claims, 2 Drawing Sheets

TENNIS RACKET FRAME

BACKGROUND OF THE INVENTION

1. Field of the Invention

The present invention generally relates to a frame member for a tennis racket, and more particularly to a frame member suitable for use in a tennis racket designed for children or players of slight muscular power which is made of a fiber reinforced resin compact in size and light weight, but having superior strength and vibration absorbing properties.

2. Description of Prior Art

The recent increasing popularity of tennis brings an early start of play even from children, and therefore a compact tennis racket light in weight is strongly desired for such small players, particularly a tennis racket which does not promote tennis elbow and with a high vibration absorbing property is desired. This also applies to a tennis racket for players having slight power.

In general, a frame member for a tennis racket has conventionally been made of a fiber reinforced resin which is composed of, as is known, (1) a continuous fiber/resin matrix or (2) a short or chopped fiber/resin matrix.

For the resin matrix (1), a thermosetting resin such as epoxy, polyester or phenol resin is used. The thermosetting resin is infiltrated into a continuous filament, which is heated and pressurized to thereby set and form the resin into a desired shape.

On the other hand, the resin matrix (2) above consists of a fiber reinforced member of short discontinuous fibers having a reinforcing member dispersed at random in the resin matrix. Either of the two thermoplastic and thermosetting resins can be employed for the resin matrix (2) which is formed mainly through injection molding.

The frame member for a tennis racket should possess strong toughness, rigidity, resilience and vibration absorbing characteristics. Particularly, the racket frame for children's use is necessary to be compact in size and light in weight as well while maintaining the above-mentioned characteristics.

The fiber reinforced resin of the above type (1) contains 60–70 weight % of reinforcing fibers having high rigidity such as carbon fibers, thereby realizing necessary toughness and bending elasticity. However, the epoxy resin or polyester resin used as the matrix resin is inferior in toughness.

Although it has been considered to increase the weight of the reinforcing fibers contained in the resin so as to increase the toughness and rigidity, the vibration absorbability of the racket is undesirably degraded and the weight of the racket as a whole is increased. The amount of reinforcing fibers is naturally increased particularly in the case of the racket frame designed for children since the racket for children should be smaller in size while maintaining strength and rigidity. Therefore, the conventional racket frame for children is eventually heavy in weight with reduced vibration absorbability, whereby the tennis elbow referred to above is easily brought about to the player's elbow at the side with the racket.

Meanwhile, the molecular weight of the matrix resin in the fiber reinforced resin of the above type (2) is small in consideration of the fluidity at the injection molding. At the same time, reinforcing fibers are contained at 30% by weight or so. In many cases, the length of a fiber is not longer than 1 mm after the fibers are turned into pellets and injection-molded. Since the matrix resin having a low molecular weight is used and the reinforcing fibers are very short in length, the strength of the frame member of the type (2) is considerably lowered. Therefore, the racket frame may be broken during the use. Moreover, if it happens that the tennis racket with gut is accommodated in a trunk of a motor vehicle at 80° C. or higher, it may be deformed. Although these inconveniences might be covered by making the racket frame thick, in such a case, the resulting racket frame is heavy in weight and is therefore not suitable particularly for children and players of small power.

As described hereinabove, the conventional frame member for a tennis racket has such disadvantages as poor vibration absorbing property and heavy weight the like. The vibration absorbing property is especially important for the children's racket frame, because it is more undesirable to growing children as compared with adults to have shocks on the elbow. Accordingly, it is necessary to reduce the burden on the elbow as much as possible in order for the children with a future to continue playing for a long time.

SUMMARY OF THE INVENTION

An essential object of the present invention is to provide a frame member for a tennis racket which is light in weight and compact in size with high resilience and superior vibration absorbability, without causing disturbances to the elbow of children or small-power players.

In accomplishing the above-described object, according to the present invention, a tennis racket frame has a total weight of 230–300 g, total length of 52–67 cm and a periodic damping ratio of 0.5–4.0%, which is made of a fiber reinforced resin composed of polyamide resin reinforced by a continuous and/or long fiber reinforcing material.

The frame for a tennis racket according to the present invention is further provided with a resin layer containing a non-woven fabric at the inside, outside and/or in the middle of a layer of the above-described fiber reinforced resin.

The above polyamide resin having intrinsic viscosity of 1.8 $\eta$ or more contains 10–80% by weight of the above-described fiber reinforcing material which is desirably subjected to surface treatment by a nylon surface treating material soluble in alcohol, water, or both.

Depending on the use, the above fiber reinforcing material may be carbon fiber, glass fiber, alamide fiber, alumina fiber, siliundum fiber, organic fiber, steel wire, amorphous metal fiber and/or their mixture in the form of a cloth, sleeve or roving.

The non-woven fabric on the surface at the outside, inside and/or in the intermediate of the fiber reinforcing material is, for example, glass fiber paper, carbon fiber paper, polyester non-woven fabric or nylon non-woven fabric, etc. The non-woven fabric has the fiber density of 1–35 Vol %, preferably 2–20 Vol % so as to gain a suitable flow of the resin at the molding.

The fiber reinforced resin is preferably processed through monomer casting. More specifically, the continuous fiber and/or long fiber reinforcing material is put around a center core (inner pressure retainer) into a predetermined shape, and furthermore the non-woven fabric is installed at the outer face, inner face and/or in the middle of the reinforcing material. Then, the reinforcing material and the non-woven fabric are set in a mold into which a molten ω-lactum containing polymerization catalyst and initiator is injected. Thus, when the mold is heated, polyamide resin is obtained.

The center core (inner pressure retainer) may be of any material that is flexible to run along the mold through injection of the air, such as, nylon, cellophane, rubber, polyester, polyeterketone or the like in the form of a tube or bag.

For the above-described ω-lactum, α-pyrrolidone, α-piperidone, ε-caprolactam, ω-enanthlactum, ω-caprylolactum, ω-pelargonolactum, ω-decanolactum, ω-undecanolactum, ω-laurolactum or c-alkyl substituted-lactum of these, or a mixture of two or more kinds of these ω-lactum, or the like is used. The ω-lactum can contain improved components (soft components) as necessary.

The soft component has a functional group reacting to the using initiator in its molecule, and is a compound of small Tg. Therefore polyester or liquid polybutadiene having a functional group is generally employed as the soft component.

UBE nylon (UX-21) manufactured by Ube Kosan, Co., Ltd. and the like is a commercially-available material for the above ω-lactum, which is composed of a component A made of alkali catalyst and caprolactum and a component B made of prepolymer containing a soft component and caprolactum.

Although sodium hydride NaH is preferable for the anionic catalyst according to the present invention, it may be possible to use the other well-known ω-lactum polymerization catalyst such as natrium, calium, lithium hydroxide or the like. The polymerization catalyst is preferably added 0.1–0.5 mol % to the ω-lactum.

In the meantime, N-acetyl-ε-caprolactum is used for the polymerization initiator, but triallylisocyanulate, N-substituted ethylenimine derivative, 1.1'-carbonylbisaziridine, oxazoline derivative, 2-(N-phenylbenzimidoil)acetanilide, 2-N-morpholinocyclohexane-1.3-dicarboxyanilide, or a well-known compound of isocyanurate, carbodiimide may be used. It is preferable to add 0.05–1.0 mol % of the polymerization initiator to the ω-lactum. Moreover, it is not inconvenient to use any of the following methods to add the polymerization initiator;

(a) to directly add the polymerization initiator to the ω-lactum liquid containing the anionic catalyst, (b) to mix the ω-lactum liquid containing the anionic catalyst with the ω-lactum containing the polymerization initiator, and (c) to preliminarily add the polymerization initiator together with the anionic catalyst in the solid or liquid ω-lactum.

The polymerization temperature is generally preferably 120°–200° C.

As is described hereinabove, the tennis racket frame according to the present invention is in the range of 230–300 g of the total weight and 52–67 cm of the total length which is suitable for children. Moreover, the frame has a large periodic damping ratio of 0.5% or more, thereby contributing to a reduction of the burden players of slight power would suffer on the elbow.

At the same time, since polyamide resin which is much tougher and superior in periodic damping characteristics than the conventionally used epoxy, polyester or phenol resin is employed for the matrix resin in the fiber reinforced material, the amount of reinforcing fibers contained in the reinforced material and consequently the weight of the frame member can be reduced, and the periodic damping characteristic of the frame can be further improved. Accordingly, the tennis racket frame according to the present invention is most fit for children and players of small muscle.

Furthermore, since a resin layer containing a non-woven fabric is installed at the outer face, inner face or/and in the middle of the layer of continuous or/and long fiber reinforced resin, and the resin layer is almost totally composed of a resin containing a very small amount of fibers, approximately 95% of the matrix resin and 5% of the non-woven fabric, the periodic damping property of the frame member can be enhanced. Accordingly, the tennis racket can be compact in size and light in weight with good appearance.

BRIEF DESCRIPTION OF THE DRAWINGS

This and other objects and features of the present invention will become apparent from the following description taken in conjunction with preferred embodiments thereof with reference to the accompanying drawings, in which.

DESCRIPTION OF PREFERRED EMBODIMENTS

Figure 1:
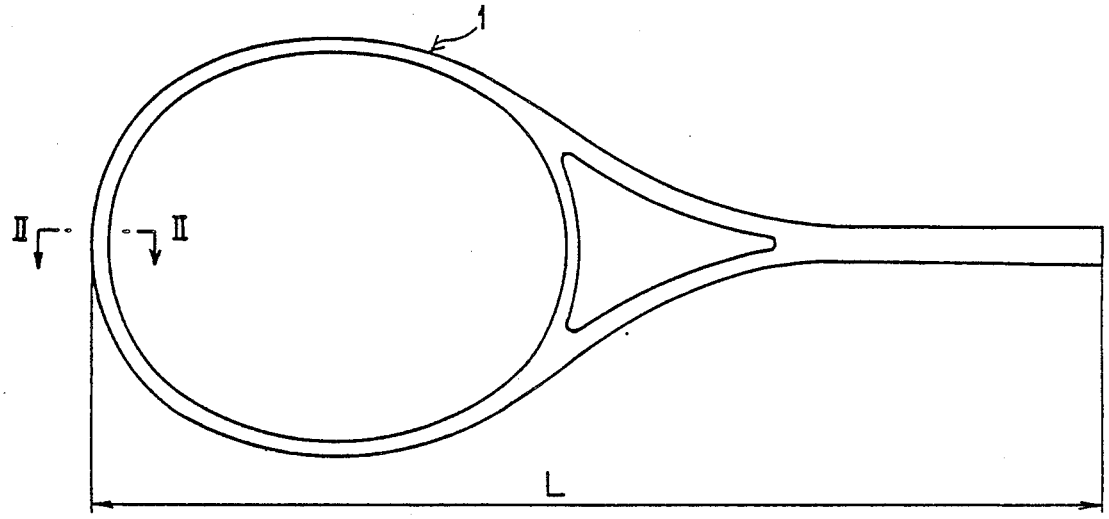
FIG. 1 is a plan view showing a tennis racket frame designed for children according to the present invention.

Before the description of the present invention proceeds, it is to be noted here that like parts are designated by like reference numerals throughout the accompanying drawings.

Referring first to FIG. 1, a tennis racket frame 1 shown therein of the present invention has total length L 52–67 cm (the shortest 52 cm according to the instant embodiment), and a total weight 230–300 g (the lightest 230 g according to the instant embodiment). Moreover, the periodic damping ratio of the frame 1 is 1.5% which is considerably improved in comparison with that of the conventional tennis racket frame.

Figure 2:
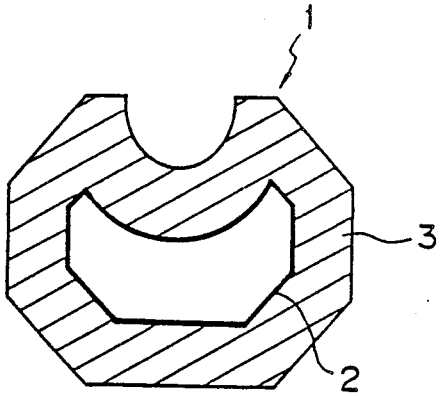
FIG. 2 is a cross sectional view taken along the line II—II of FIG. 1 according to a first embodiment of the present invention.

As indicated in FIG. 2, the tennis racket frame 1 has a center core 2 of a nylon tube which is surrounded at the outer periphery thereof with a fiber reinforced resin layer 3 composed of polyamide resin containing continuous carbon fibers.

The racket frame 1 is manufactured through monomer casting which will be described hereinbelow.

Specifically, the center core 2 is formed of a nylon tube having 100 μm thickness. Carbon fibers which are subjected to surface treatment by a methanol solution of nylon A70 (Toray Co., Ltd.) soluble in alcohol are arranged in a network structure, with the tube 2 placed at the center, so that the fiber angle to the elongated direction of the frame is kept at 24° (6K24, product name;BC-7664-24(20) Toho Rayon Co., Ltd.), resulting in 60 weight %.

After the network structure is set in a mold, the mold is heated at 150° C. and then the pressure in the mold is reduced by a vacuum pump.

Thereafter, the ω-lactum containing the polymerization catalyst and initiator melted at 90° C. is injected into the mold. According to the instant embodiment, commercially-available UBE nylon (UX-21) of Ube Kosan Co., Ltd. is used for the above-described ω-lactum. The component A made of alkali catalyst and caprolactum and the component B made of prepolymer containing a soft component and caprolactum are melted by heat and quickly mixed by the ratio 1:1, which is in turn injected into the mold. In this state, while an inner pressure is added within the tube 2, a tennis racket frame having a hollow structure as shown in FIG. 2 is obtained.

Figure 3:
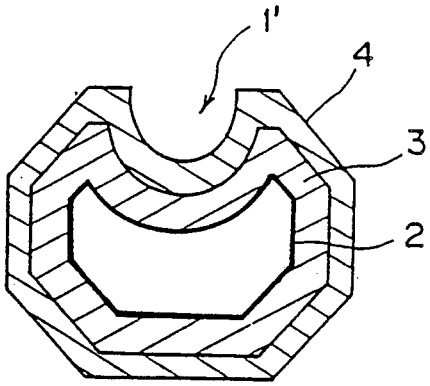
FIGS. 3 and 4 are cross sectional views similar to FIG. 2 according to second and third embodiments of the present invention, respectively.

FIG. 3 shows a tennis racket frame 1' according to a second embodiment of the present invention. The tennis racket frame 1' has the center core 2 of a nylon tube, the fiber reinforced resin layer 3 made of polyamide resin containing continuous carbon fibers at the outer periphery of the center core, and a layer 4 made of polyamide resin containing a glass non-woven fabric at the outside of the resin layer 3.

The length and weight of the frame 1' are substantially equal to those of the frame 1 of the first embodiment, and the periodic damping ratio of the frame 1' is remarkably improved to be 2.5% as compared with that of the conventional tennis racket frame.

The racket frame 1' provided with the layer 4 is manufactured generally in the same manner as in the first embodiment, except that about 5% by weight of the glass non-woven fabric is arranged on the surface of the carbon fibers with the core tube 2 set at the center thereof.

Figure 4:
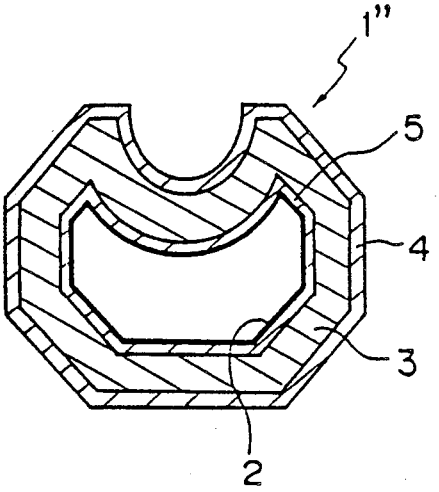
Figure 7:
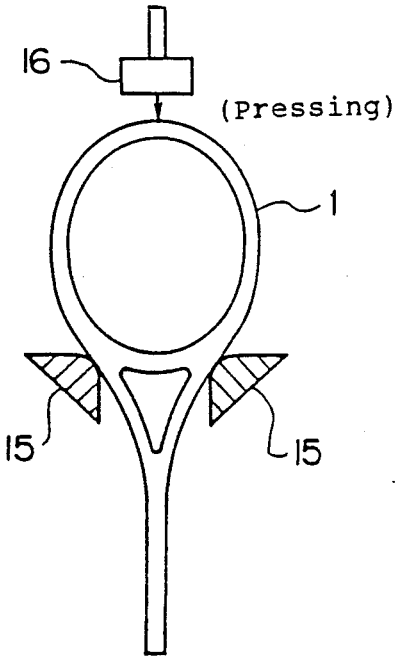
FIG. 7 is a view schematically illustrating the method to test the strength of the tennis racket frame.

A racket frame 1'' according to a third embodiment of the present invention is indicated in FIG. 4. The racket frame 1'' is provided with the center core 2 of a nylon tube, an inner layer 5 made of polyamide resin containing a non-woven glass fabric at the outer periphery of the core 2, the fiber reinforced resin layer 3 made of polyamide resin containing continuous fibers at the outer periphery of the inner layer 5 and an outer layer 4 made of polyamide resin containing a non-woven glass fabric at the outer periphery of the resin layer 3.

The racket frame 1'' has the same shape and weight as the racket frame 1, with a periodic damping ratio of 3.5%. The racket frame 1'' is manufactured generally in the same manner as in the first embodiment. The difference is that the non-woven glass fabric is placed at the outer periphery of the center core tube 2, and the layer of continuous fibers surround the outer periphery of this non-woven glass fabric. Further, another non-woven glass fabric is provided at the outer periphery of the layer of continuous fibers before the frame member is set in the mold.

It is to be noted here that the layer containing the non-woven fabric may be placed in the intermediate layer interposed between the fiber reinforced resin layers, but it is better to place the layer at the outermost surface of the fiber reinforced layer for the purpose of providing a good appearance.

Experiment 1

The periodic damping property is compared between the tennis racket frame of the present invention in the above-described structure and the conventional tennis racket frame, the result of which will be discussed hereinbelow.

A: a tennis racket frame according to the first-third embodiments of the present invention (total weight 230 g and total length 52 cm)

B: a conventional tennis racket frame formed of epoxy prepared in the same shape as the above frame A

Experiments of the periodic damping property using a testing instrument

Figure 5:
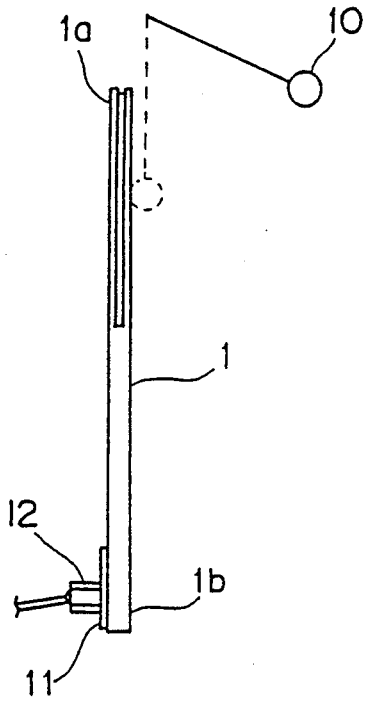
FIG. 5 is a view schematically illustrating the method to test the periodic damping property of the tennis racket frame.
Figure 6:
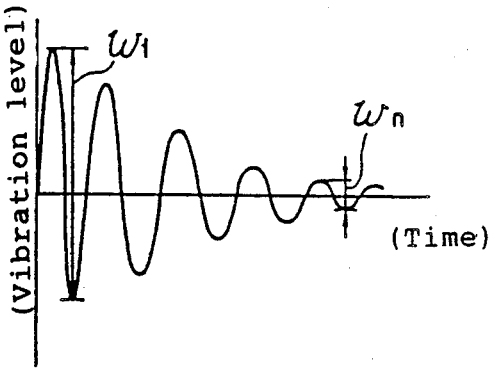
FIG. 6 is a diagram showing the waveform of periodic damping obtained by the test.

As shown in FIG. 5, a tennis ball 10 is hung by a string, and also the tennis racket frame 1 is hung by a string with a head 1*a* kept above. The periodic damping in the racket when the ball 10 is allowed to fall on the center of the gut surface of the racket is detected by an accelerometer 12 mounted via an aluminum plate 11 at a grip 1*b*, and monitored as waveforms on a cathode ray tube as indicated in FIG. 6.

The damping ratio $\zeta$ is calculated based on the waveforms obtained by the above experiments.

$$\zeta = \frac{1}{2\pi(n-1)} \ln \frac{\omega_l}{\omega_n}$$

From this formula, the tennis racket frame A according to the first-third embodiments of the present invention have damping ratios $\zeta$ as follows;

according to the first embodiment $\zeta = 1.5\%$ according to the second embodiment $\zeta = 2.5\%$ according to the third embodiment $\zeta = 3.5\%$ Meanwhile, the conventional tennis racket frame B has the damping ratios 0.2–0.3% (average of 10 rackets).

Result of feeling test through actual use 25 players use alternately the racket A and conventional racket B. The result is;

23 players express the feeling that the racket A has better vibration absorbability, 2 of the 23 express the feeling that the difference is unknown.

Comparative test of strength

An upper end (top) of the racket frame 1 is added with a static load by a pressuring tool 16 from above while both of the right and left sides of the frame 1 are supported upright by a supporting jig 15. The breaking strength at the top is compared between the racket frame of the second embodiment and the comparative racket B.

the racket frame according to the second embodiment (average of four rackets) . . . 162 kg the comparative racket B (average of four rackets) . . . 160 kg As is understood from the above test, the racket frame according to the present invention is approximately equivalent in strength to the conventional racket frame.

The racket frame according to the present invention is constituted of polyamide resin reinforced by continuous fibers or long fibers. Since the polyamide resin is strongly tough, even when the total weight and total length of the racket frame are reduced, the racket frame can maintain its strength and rigidity. Moreover, since the polyamide resin itself has a large periodic damping characteristic in comparison with the conventionally employed thermosetting resin, the racket frame can be light in weight and compact in size while maintaining its rigidity and superior periodic damping property. The periodic damping property can be further improved in the event the racket frame is provided with a resin layer composed of less fibers, 95% of matrix resin and 5% or so of non-woven fabric. As discussed above, the racket frame according to the present invention is particularly superior in its periodic damping property, so that it can restrict transmission of vibrations to the player's elbow, thereby reducing the possibility of tennis elbow. Accordingly, the tennis racket frame of the present invention is particularly suitable for children Although the present invention has been fully described by way of example with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A tennis racket frame having a total weight of 230–300 g, a total length of 52–67 cm, and an improved periodic damping ratio of 0.5–4.0% comprising:

a center core;

a fiber reinforced matrix resin manufactured through monomer casting including a polyamide resin reinforced by a fiber reinforcing material;

an inner resin layer positioned between said center core and said fiber reinforced matrix resin; and an outer resin layer positioned on an exterior surface of said fiber reinforced matrix resin, wherein said inner and outer resin layers contain a non-woven fabric having a fiber content that is 80–98 Vol. % of said fiber reinforced matrix resin and 2–20 Vol. % of the non-woven fabric.

2. The tennis racket frame according to claim 1, wherein said periodic damping ratio is 3.5%.

3. The tennis racket frame according to claim 1, wherein said polyamide resin contains 10–80% by weight of said fiber reinforcing material.

4. The tennis racket frame according to claim 1, wherein said fiber reinforcing material contains continuous fibers.

5. The tennis racket frame according to claim 1, wherein said fiber reinforcing material contains long fibers.

6. The tennis racket frame according to claim 1, wherein said fiber reinforcing material contains both continuous and long fibers.

7. The tennis racket frame according to claim 1, wherein said fiber reinforcing material is selected from the group consisting of carbon fiber, glass fiber, alamide fiber, alumina fiber, siliundum fiber, organic fiber, steel wire, amorphous metal fiber and/or their mixture in the form of a cloth, sleeve, or roving.

8. The tennis racket frame according to claim 1, wherein said non-woven fabric has a fiber density of 1–35 Vol % and is selected from the group consisting of glass fiber paper, carbon fiber paper, polyester fabric and nylon non-woven fabric.

9. The tennis racket frame according to claim 1, wherein said fiber reinforcing material further includes a nylon surface soluble in alcohol.

10. The tennis racket frame according to claim 1, wherein said fiber reinforcing material further includes a nylon surface soluble in water.

11. The tennis racket frame according to claim 1, wherein said fiber reinforcing material further includes a nylon surface soluble in alcohol and water.

* * * * *